US007347188B2

(12) United States Patent
Ohshima

(10) Patent No.: US 7,347,188 B2
(45) Date of Patent: Mar. 25, 2008

(54) CONTROLLER FOR COMMON RAIL FUEL INJECTION SYSTEM

(75) Inventor: Keiji Ohshima, Gamagori (JP)

(73) Assignee: Denso Corporation, Kariya-city, Aichi-pref. (JP)

( * ) Notice: Subject to any disclaimer, the term of this patent is extended or adjusted under 35 U.S.C. 154(b) by 44 days.

(21) Appl. No.: 11/507,560

(22) Filed: Aug. 22, 2006

(65) Prior Publication Data

US 2007/0044763 A1 Mar. 1, 2007

(30) Foreign Application Priority Data

Sep. 1, 2005 (JP) ..... 2005-253695

(51) Int. Cl.
*F02M 59/36* (2006.01)
*F02M 59/20* (2006.01)

(52) U.S. Cl. ..... 123/458; 123/456

(58) Field of Classification Search ..... 123/458, 123/456, 457, 511, 696, 497
See application file for complete search history.

(56) References Cited

U.S. PATENT DOCUMENTS 5,237,975 A * 8/1993 Betki et al. ..... 123/497

FOREIGN PATENT DOCUMENTS

| | | | |
|---|---|---|---|
| JP | 2002-276500 | | 9/2002 |
| JP | 2004-5446 | | 1/2004 |
| JP | 200576618 | * | 3/2005 |

* cited by examiner

*Primary Examiner*—Mahmoud Gimie
(74) *Attorney, Agent, or Firm*—Nixon & Vanderhye P.C.

(57) ABSTRACT

In a common rail fuel injection system, a fuel pump pressure-feeds fuel to a common rail, which accumulates the fuel at high pressure corresponding to fuel injection pressure. An electronic control unit (ECU) drives and controls a suction control valve provided in the fuel pump to regulate a pressure-feeding amount of the fuel and to perform fuel pressure feedback control. The ECU calculates a differential term of a control amount of the suction control valve based on a pressure deviation of the fuel pressure in the common rail with respect to target pressure. The ECU sets the differential term at zero when the fuel pressure is higher than the target pressure and the differential term of the control amount is a value for pressure-feeding the fuel.

7 Claims, 4 Drawing Sheets

COMPARATIVE EXAMPLE

COMPARATIVE EXAMPLE

CONTROLLER FOR COMMON RAIL FUEL INJECTION SYSTEM

CROSS REFERENCE TO RELATED APPLICATION

This application is based on and incorporates herein by reference Japanese Patent Application No. 2005-253695 filed on Sep. 1, 2005.

BACKGROUND OF THE INVENTION

1. Field of the Invention

The present invention relates to a controller of a common rail fuel injection system for performing feedback control of fuel pressure.

2. Description of Related Art

In a common rail fuel injection system, a fuel pump pressure-feeds fuel and a common rail accumulates the fuel at high pressure corresponding to fuel injection pressure. The fuel accumulated in the common rail is injected and supplied into an engine through fuel injection valves. The common rail is provided with a fuel pressure sensor, which senses actual pressure of the fuel. The fuel pressure feedback control is performed to conform the sensed actual pressure to target pressure determined based on operation information of the engine. In the fuel pressure feedback control, a suction control valve provided at a suction section of the fuel pump is driven and controlled to regulate a fuel amount pressure-fed to the common rail, for example, as described in JP-A-2002-276500.

Generally, in the fuel pressure feedback control, a proportional term, an integral term and a differential term of a control amount of the drive control of the fuel pump are calculated based on the pressure deviation of the actual pressure with respect to the target pressure. Specifically, the differential term is calculated in accordance with a fluctuation tendency of the pressure deviation. The differential term has a predictive effect with respect to the change of the target pressure. The differential term is effective in improvement of following performance of the actual pressure in the case where the target pressure rapidly changes or improvement of a phase lag in the case where the target pressure cyclically fluctuates, for example.

However, due to an operation delay in a control object with respect to a control output or transport delay of the fuel through a fuel pressure-feeding pipe, a temporal deviation is generated between the time when the calculated control amount is outputted to the fuel pump and the time when the calculated control amount is sufficiently reflected in the actual pressure. Therefore, in the case where the change tendency of the target pressure changes in accordance with the operation condition of the engine, there is a possibility that reliability of validity of the control amount disappears and the actual pressure exhibits an unintended behavior due to an influence of the differential term calculated as of the change. No problem is caused if the influence of the differential term is absorbed by the other parameters of the proportional term and the integral term. However, the influence of the differential term increases and the other parameters cannot absorb the influence of the differential term specifically in the case where the pressure deviation rapidly changes in accordance with the target pressure. Aimed and suitable fuel injection to the engine cannot be performed if the actual pressure exhibits an unintended behavior. As a result, particulate matters or nitrogen oxides contained in exhaust gas will increase or an abnormal noise will be caused.

SUMMARY OF THE INVENTION

It is an object of the present invention to provide a controller of a common rail fuel injection system capable of performing suitable fuel injection by averting an unintended behavior of fuel pressure in fuel pressure feedback control.

According to an aspect of the present invention, a controller for a common rail fuel injection system senses fuel pressure in a common rail and calculates a differential term of a control amount of a fuel pump based on a pressure deviation of the sensed fuel pressure with respect to target pressure. Reflection of the differential term in the control amount is restricted when the pressure deviation increases in accordance with an increase of the target pressure during reduction of the fuel pressure.

In the fuel pressure feedback control for conforming the fuel pressure in the common rail to the target pressure, a differential term based on the pressure deviation is calculated as the control amount of the fuel pump. The differential term has an effect of predicting a fluctuation tendency of the pressure deviation and is used to improve following performance of the fuel pressure. However, a temporal deviation is generated until the control amount is reflected in the fuel pressure because of a control delay of the fuel pump and the like. If the fluctuation tendency of the pressure deviation, which is predicted when the control amount is calculated, changes when the fluctuation tendency is actually reflected in the fuel pressure, there is a possibility that the fuel pressure exhibits an unintended behavior due to an influence of the differential term calculated at the change. Therefore, the reflection of the differential term in the control amount is restricted when the differential term affects the fuel pressure, i.e., when the pressure deviation fluctuates in accordance with the increase of the target pressure and the differential term affects the fuel pressure during the reduction of the fuel pressure.

Thus, in the common rail fuel injection system in which the temporal deviation is caused until the control amount is reflected in the fuel pressure, an unintended increase of the fuel pressure can be averted when the target pressure increases during the reduction of the fuel pressure. Accordingly, aimed and suitable fuel injection can be performed. As a result, generation of particulate matters or nitrogen oxides in exhaust gas is inhibited, and generation of an abnormal sound is inhibited.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
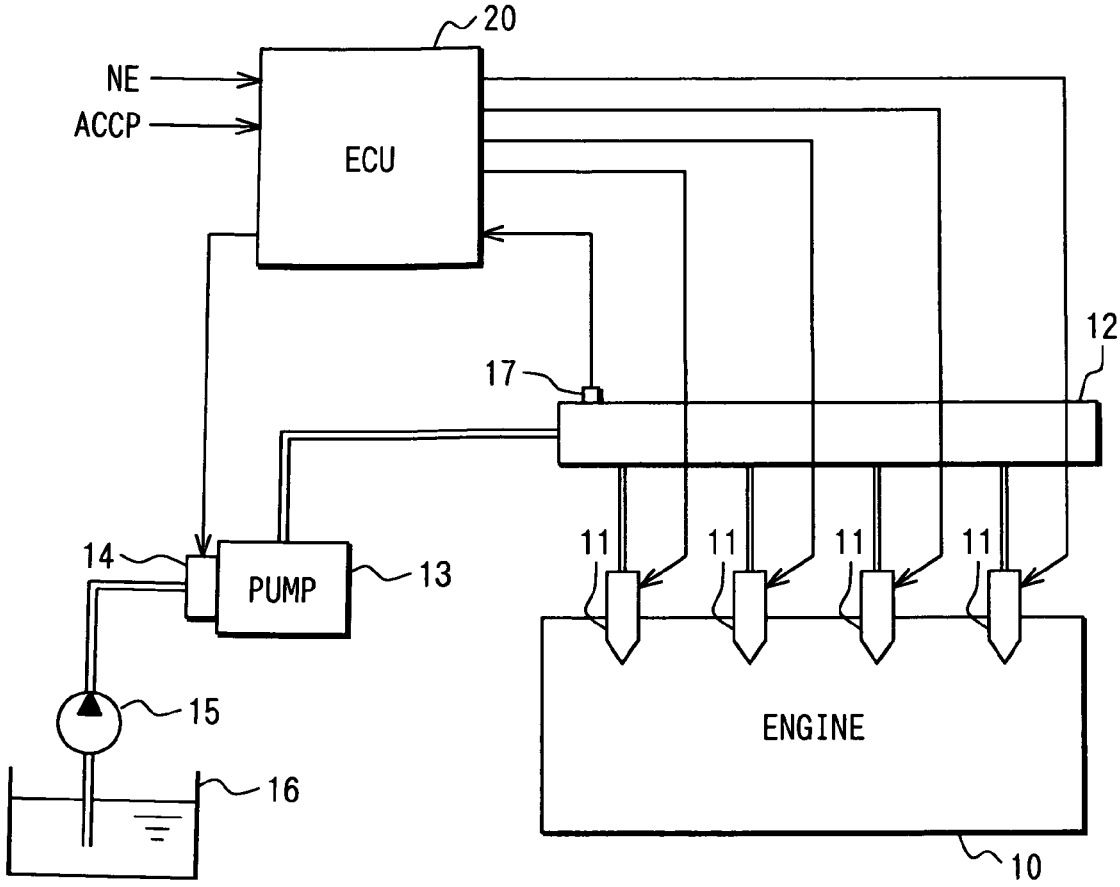
FIG. 1 is a schematic diagram showing a common rail fuel injection system according to an example embodiment of the present invention.

Referring to FIG. 1, a common rail fuel injection system according to a first example embodiment of the present invention is illustrated. In FIG. 1, electromagnetic injectors 11 are mounted in respective cylinders of a multi-cylinder diesel engine 10 of a vehicle. The injectors 11 are connected to a common rail (pressure accumulation pipe) 12 common to the cylinders. The common rail 12 is connected with a high-pressure pump 13. In accordance with drive of the high-pressure pump 13, fuel at high pressure corresponding to injection pressure is accumulated in the common rail 12. An electromagnetic suction control valve (SCV) 14 is provided at a suction portion of the high-pressure pump 13. The SCV 14 is connected with a fuel tank 16 through a feed pump 15. If the feed pump 15 draws the fuel from the fuel tank 16, the fuel is metered by the SCV 14 and is suctioned into the high-pressure pump 13. Then, the fuel is pressure-fed to the common rail 12. The common rail 12 is provided with a fuel pressure sensor 17 for sensing fuel pressure accumulated in the common rail 12.

The SCV 14 is a normally-closed electromagnetic solenoid valve. If an electromagnetic solenoid is energized, a needle moves in the SCV 14. A valve opening degree of the SCV 14 is regulated by the movement of the needle to meter the fuel suctioned into the high-pressure pump 13. The high-pressure pump 13 is driven in accordance with rotation of a crankshaft (not shown) of the engine 10. The high-pressure pump 13 repeats pressure-feeding operation for suctioning and discharging the fuel in a predetermined cycle (cycle of 180° CA, in the present embodiment).

An electronic control unit (ECU) 20 is structured mainly by a microcomputer having CPU, ROM, RAM, and the like. The ECU 20 executes control programs stored in the ROM to perform various types of control related to an operation of the engine 10. Operation information such as a sensing signal of the fuel pressure sensor 17, engine rotation speed NE or an accelerator operation amount ACCP is continuously inputted into the ECU 20. The ECU 20 calculates optimum fuel injection timing and injection amount based on the inputted operation information and outputs an injection control signal to the injectors 11 in accordance with the fuel injection timing and the injection amount. Thus, fuel injection from the injectors 11 to the engine 10 is performed in the respective cylinders.

The ECU 20 calculates target pressure Pctg of the fuel in the common rail 12 based on the calculated fuel injection amount. The ECU 20 performs fuel pressure feedback control for conforming the actual fuel pressure (actual pressure) Pc in the common rail 12 to the target pressure Pctg. The change of the target pressure Pctg substantially corresponds to the change of the accelerator operation amount ACCP. Processing related to the fuel pressure feedback control is performed in a predetermined cycle (cycle of 180° CA as a cycle of every combustion of each cylinder, in the present embodiment).

In the fuel pressure feedback control, the SCV 14 is driven and controlled to regulate the fuel amount pressure-fed from the high-pressure pump 13 to the common rail 12. In the drive control of the SCV 14, PID control is performed and a control amount U corresponding to the opening degree of the SCV 14 is calculated. In the calculation of the control amount U, a proportional term Up, an integral term Ui and a differential term Ud are calculated based on a pressure deviation ΔP of the actual pressure Pc with respect to the target pressure Pctg (ΔP=Pctg−Pc). The control amount U is calculated by adding the terms Up, Ui, Ud (U=Up+Ui+Ud). The differential term Ud is calculated by multiplying a change of the pressure deviation ΔP by a differential gain Kd. The change of the pressure deviation ΔP is calculated by subtracting the pressure deviation ΔP as of the previous calculation of the control amount U from the present pressure deviation ΔP. A control signal corresponding to the control amount U is outputted to the SCV 14.

If the control amount U is positive, the SCV 14 is opened and the high-pressure pump 13 pressure-feeds the fuel. Thus, the actual pressure Pc is increased. At that time, as the control amount U increases, the valve opening degree of the SCV 14 is increased, so the amount of the fuel pressure-fed by the high-pressure pump 13 increases and the actual pressure Pc in the common rail 12 rapidly increases. If the control amount U is negative, the SCV 14 is closed and the high-pressure pump 13 does not pressure-feed the fuel. The actual pressure Pc gradually decreases due to the fuel injection by the injectors 11 or fuel leak through sliding portions of the injectors 11.

There is a temporal deviation between time when the control amount U is outputted to the SCV 14 and time when the control amount U is sufficiently reflected in the actual pressure Pc. It is because of an operation delay of the SCV 14 with respect to the control output, a delay in the pressure-feeding operation of the high-pressure pump 13 or a delay in the transportation of the fuel through a fuel pressure-feeding pipe. Accordingly, the fluctuation tendency of the pressure deviation ΔP differs between the time when the differential term Ud is calculated and the time when the differential term Ud is reflected in the actual pressure Pc. As a result, there is a possibility that reliability of the fuel pressure feedback control is deteriorated. Therefore, in the present embodiment, adjustment processing is performed when the differential term Ud is calculated.

In the calculation of the control amount U, a compensation term Uf for compensating for the operation delay of the SCV 14 may be calculated based on the fluctuation of the target pressure Pctg through feed-forward control and may be reflected in the control amount U (U=Up+Ui+Ud+Uf). Thus, the operation delay of the SCV 14 is improved. However, the temporal deviation until the calculated control amount U is reflected in the actual pressure Pc is still caused by the pressure-feeding operation of the high-pressure pump 13 and the like.

Figure 2A:
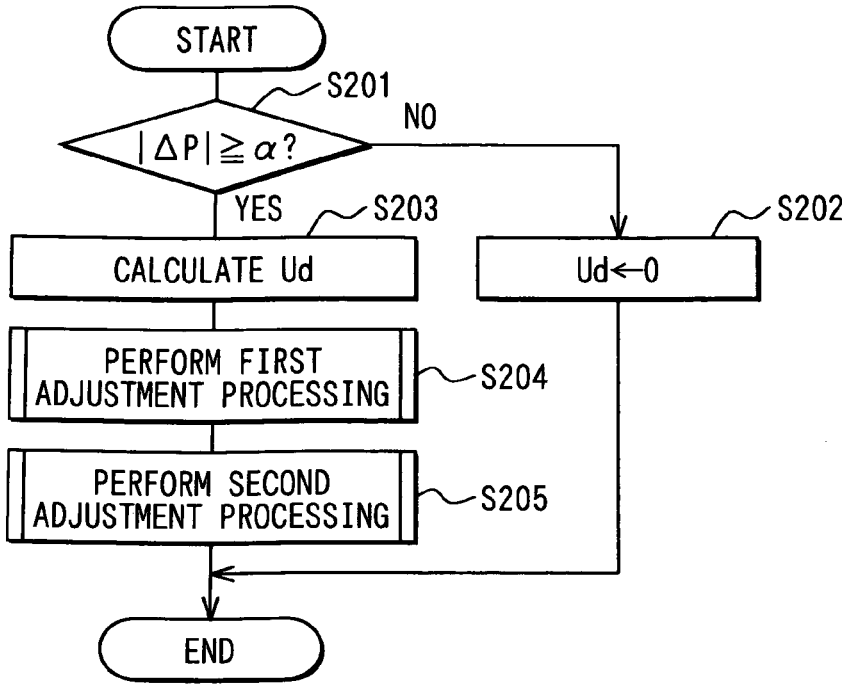
FIG. 2A is a flowchart showing processing steps for calculating a differential term of a control amount of a suction control valve of a high-pressure pump according to the FIG. 1 embodiment.
Figure 2B:
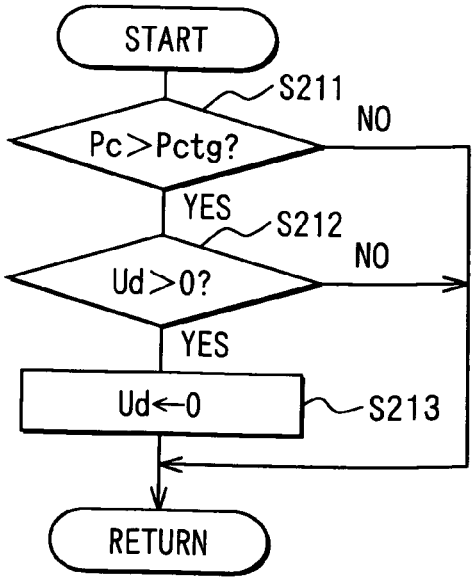
FIG. 2B is a flowchart showing processing steps of first adjustment processing of the differential term according to the FIG. 1 embodiment.
Figure 2C:
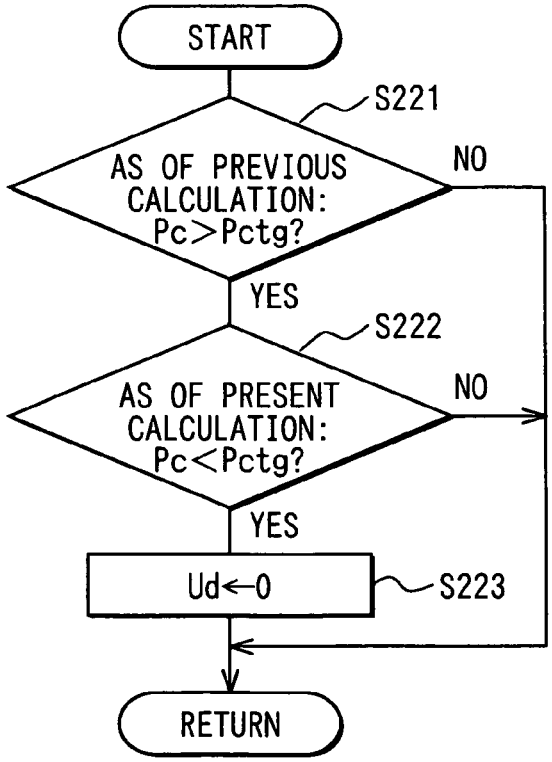
FIG. 2C is a flowchart showing processing steps of second adjustment processing of the differential term according to the FIG. 1 embodiment.

FIGS. 2A to 2C are flowcharts showing differential term calculation processing steps for calculating the differential term Ud. In the differential term calculation processing shown in FIGS. 2A to 2C, the differential term Ud is calculated based on the pressure deviation ΔP, and suitable adjustment is performed when the differential term Ud behaves as a disturbance factor. The differential term calculation processing is performed when the control amount U is calculated in the fuel pressure feedback control processing performed by the ECU 20 in the predetermined cycle.

First, Step S201 of FIG. 2A determines whether the pressure deviation ΔP (absolute value) is "equal to or greater than" a predetermined value α (around 4 MPa, in the present embodiment). If the answer to Step S201 is NO, Step S202 sets the differential term Ud at zero and the differential term calculation processing is ended. If the answer to Step S201 is YES, the processing goes to Step S203. Thus, the differential term Ud is not reflected in the control amount U when the actual pressure Pc is close to the target pressure Pctg. Step S203 calculates the differential term Ud of the control amount U based on the pressure deviation ΔP. Then, Steps S204 and S205 perform first and second adjustment processing respectively. After the first and second adjustment processing, the differential term calculation processing is ended.

The first adjustment processing shown in FIG. 2B averts an unintended increase of the actual pressure Pc in the case where the target pressure Pctg increases during the decrease of the actual pressure Pc. Step S211 determines whether the actual pressure Pc is higher than the target pressure Pctg, i.e., whether the actual pressure Pc is in the course of reduction. If the answer to Step S211 is YES, the processing goes to Step S212. If the answer to Step S211 is NO, the first adjustment processing is ended. Step S212 determines whether the calculated differential term Ud is positive. If the answer to Step S212 is YES, Step S213 sets the differential term Ud at zero, and the first adjustment processing is ended. If the answer to Step S212 is NO, the first adjustment processing is ended directly.

The second adjustment processing shown in FIG. 2C averts an excessive increase of the actual pressure Pc in the case where the actual pressure Pc is in the course of reduction as of the previous calculation of the control amount U and then the target pressure Pctg becomes higher than the actual pressure Pc because of the increase in the target pressure Pctg. Step S221 determines whether the actual pressure Pc as of the previous calculation is higher than the target pressure Pctg and is in the course of the reduction. If the answer to Step S221 is YES, the processing goes to Step S222. If the answer to Step S221 is NO, the second adjustment processing is ended. Step S222 determines whether the actual pressure Pc is lower than the target pressure Pctg. If the answer to Step S222 is YES, Step S223 sets the differential term Ud at zero, and the second adjustment processing is ended. If the answer to Step S222 is NO, the second adjustment processing is ended directly.

Figure 3A:
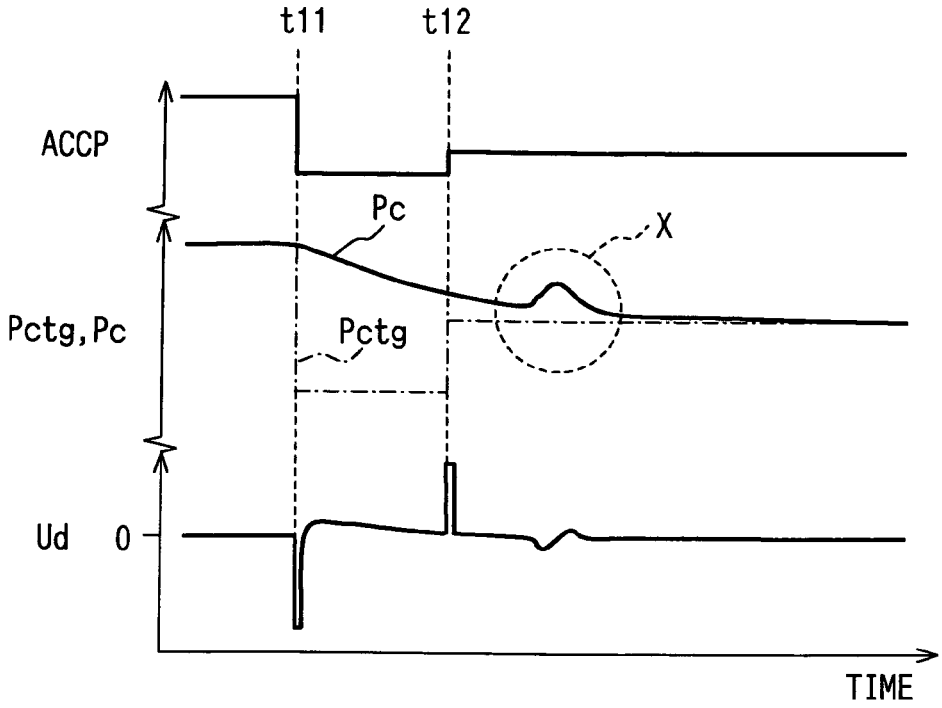
FIG. 3A is a time chart showing transitions of an accelerator position, target pressure, actual pressure and a differential term of a comparative example.
Figure 3B:
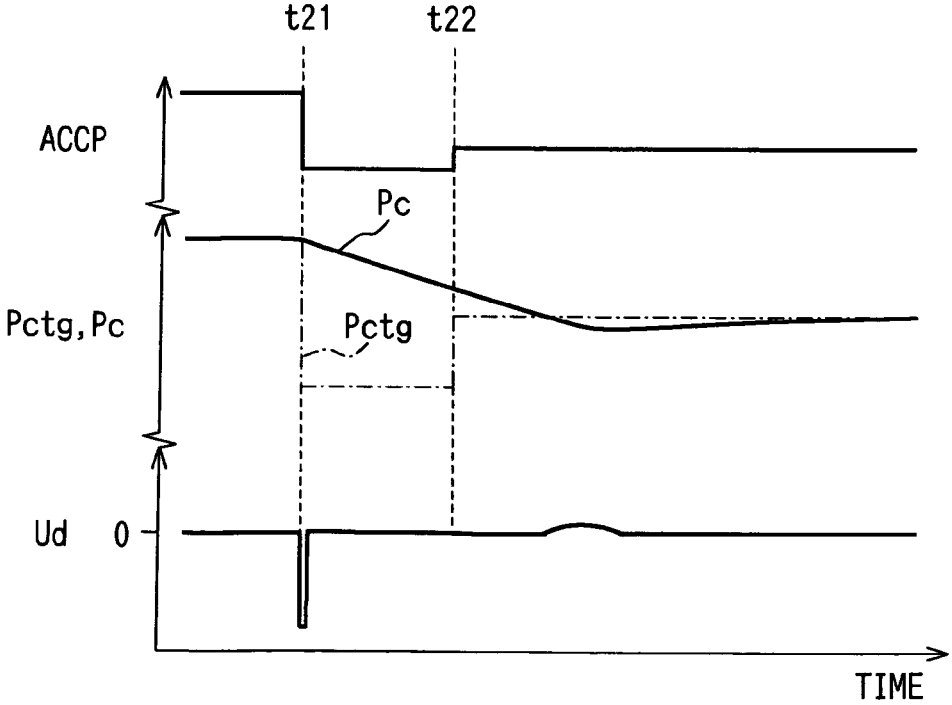
FIG. 3B is a time chart showing transitions of an accelerator position, target pressure, actual pressure and the differential term according to the FIG. 1 embodiment.
Figure 4A:
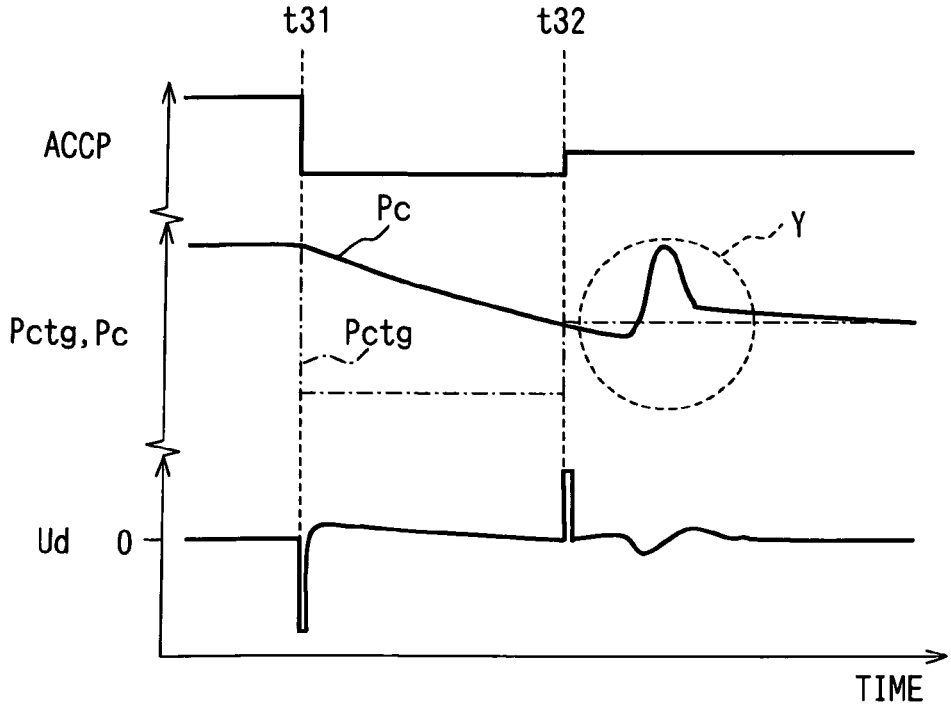
FIG. 4A is a time chart showing transitions of an accelerator position, target pressure, actual pressure and a differential term of another comparative example.
Figure 4B:
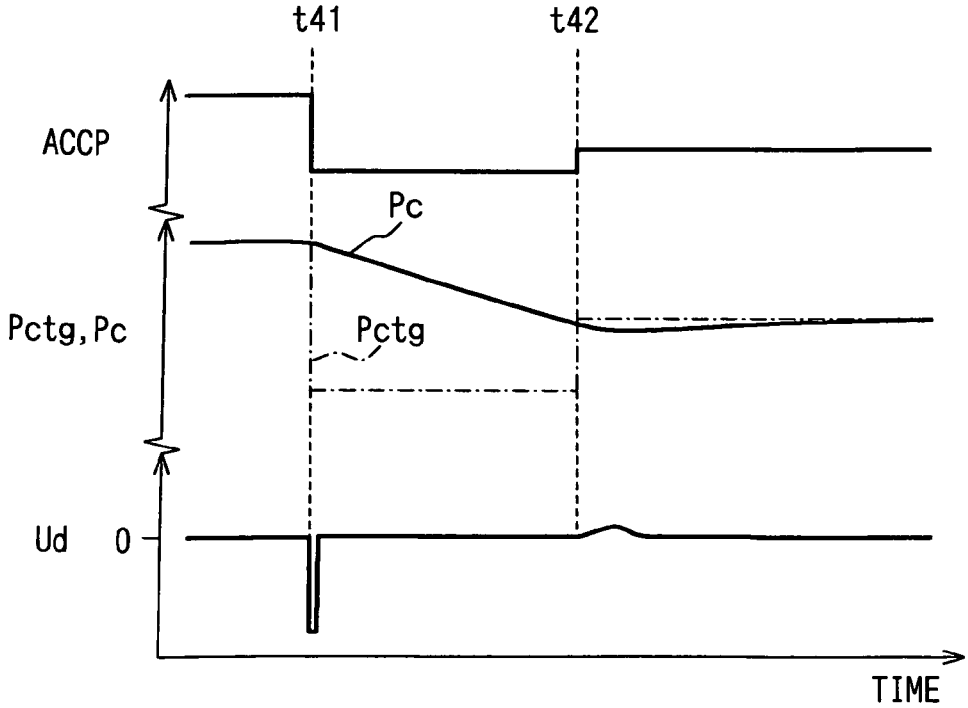
FIG. 4B is a time chart showing transitions of the accelerator position, the target pressure, the actual pressure and the differential term according to the FIG. 1 embodiment.

Next, the fuel pressure feedback control using the differential term calculation processing of FIGS. 2A-2C will be described in reference to FIGS. 3A, 3B, 4A and 4B. FIG. 3B shows an example using the first adjustment processing of FIG. 2B. FIG. 4B shows an example using the second adjustment processing of FIG. 2C. FIGS. 3A and 4A show comparative examples of conventional fuel pressure feedback control to be compared with the examples of FIGS. 3B and 4B respectively.

In the examples of FIGS. 3A and 3B, the accelerator operation amount ACCP by the driver decreases at timing t11, t21. After the state is held, the accelerator operation amount ACCP is increased at timing t12, t22. At that time, the accelerator operation amount ACCP changes in a range where the target pressure Pctg does not exceed the actual pressure Pc.

In the conventional feedback control shown in FIG. 3A, the target pressure Pctg decreases at the timing t11 in accordance with the decrease of the accelerator operation amount ACCP. Accordingly, the target pressure Pctg becomes lower than the actual pressure Pc. The control amount U of the SCV 14 becomes negative, and the high-pressure pump 13 stops pressure-feeding the fuel to the common rail 12. As a result, the actual pressure Pc gradually decreases due to the fuel leak at the injectors 11. Thereafter, if the accelerator operation amount ACCP increases at the timing t12, the target pressure Pctg increases in accordance with the increase of the accelerator operation amount ACCP. At that time, the differential term Ud temporarily increases in accordance with the change of the pressure deviation ΔP. Though the actual pressure Pc is still higher than the target pressure Pctg, the control amount U becomes positive due to the influence of the differential term Ud. The actual pressure Pc increases once when a predetermined time (time approximately ranging from from 360 to 540° CA in this example) elapses as shown in an area X in FIG. 3A.

In the case of FIG. 3B using the differential term calculation processing of FIGS. 2A to 2C, the differential term Ud remains zero even if the target pressure Pctg increases in accordance with the increase of the accelerator operation amount ACCP, specifically, at the timing t22. The differential term Ud is once calculated from the change of the pressure deviation ΔP. However, the condition that the actual pressure Pc is higher than the target pressure Pctg and the differential term Ud is positive is established in the first adjustment processing. Accordingly, the differential term Ud is adjusted in the first adjustment processing. As a result, the actual pressure Pc keeps decreasing, and then, converges to the target pressure Pctg. The unintended increase of the actual pressure Pc due to the increase of the target pressure Pctg during the reduction of the actual pressure Pc is averted.

FIG. 4A shows an example of a following behavior of the actual pressure Pc in the conventional feedback control as a comparative example. FIG. 4B shows a following behavior of the actual pressure Pc in the case where the differential term calculation processing of FIGS. 2A to 2C is applied. In the examples of FIGS. 4A and 4B, the accelerator operation amount ACCP by the driver decreases at timing t31, t41. After the state is held, the accelerator operation amount ACCP is increased at timing t32, t42. The accelerator operation amount ACCP changes to the extent that the target pressure Pctg becomes higher than the actual pressure Pc.

If the accelerator operation amount ACCP decreases at the timing t31 in the case of the conventional fuel pressure feedback control shown in FIG. 4A, the target fuel pressure Pctg decreases in accordance with the decrease of the accelerator operation amount ACCP. The control amount U of the SCV 14 becomes negative and the actual pressure Pc gradually decreases. Thereafter, if the accelerator operation amount ACCP increases at the timing t32, the target pressure Pctg increases in accordance with the increase of the accelerator operation amount ACCP. The differential term Ud temporarily increases due to the change of the pressure deviation ΔP. At that time, the target pressure Pctg becomes higher than the actual pressure Pc. Due to the influence of the differential term Ud, the actual pressure Pc excessively increases when a predetermined time (time approximately ranging from 360 to 540° CA in this example) elapses as shown by an area Y in FIG. 4A.

In the case of FIG. 4B using the differential term calculation processing of FIGS. 2A to 2C, the differential term Ud remains zero even if the target pressure Pctg increases in accordance with the increase of the accelerator operation amount ACCP, specifically, at the timing t42. The differential term Ud is once calculated as a large positive value due to the change of the pressure deviation ΔP. However, the condition that the target pressure Pctg is higher than the actual pressure Pc as of present calculation of the control amount U and the target pressure Pctg is lower than the actual pressure Pc as of previous calculation of the control amount U is established in the second adjustment processing. Therefore, the differential term Ud is adjusted in the second adjustment processing. As a result, the excessive increase of the actual pressure Pc accompanying the increase of the target pressure Pctg is averted when the target pressure Pctg becomes higher than the actual pressure Pc because of the increase of the target pressure Pctg during the reduction of the actual pressure Pc.

The above-described embodiment exerts following effects, for example.

In the fuel pressure feedback control for conforming the actual pressure Pc to the target pressure Pctg, the first and second adjustment processing is applied to the differential term Ud calculated based on the pressure deviation ΔP. Thus, the unintended behavior of the actual pressure Pc can be averted.

In the first adjustment processing shown in FIG. 2B, the adjustment of the differential term Ud with respect to the control amount U is performed when the actual pressure Pc is higher than the target pressure Pctg and the differential term Ud is a value for pressure-feeding the fuel as of the present calculation. Thus, the reflection of the differential term Ud in the control amount U is restricted when the target pressure Pctg increases during the reduction of the actual pressure Pc. Thus, the unintended increase of the actual pressure Pc due to the influence of the calculated differential term Ud is averted.

In the second adjustment processing of FIG. 2C, the adjustment of the differential term Ud is performed when the actual pressure Pc is lower than the target pressure Pctg as of the present calculation of the control amount U and the actual pressure Pc is higher than the target pressure Pctg as of the previous calculation of the control amount U. Thus, the excessive increase of the actual pressure Pc due to the influence of the calculated differential term Ud is averted by restricting the reflection of the differential term Ud in the control amount U when the actual pressure Pc changes from the state higher than the target pressure Pctg to the state lower than the target pressure Pctg because of the increase of the target pressure Pctg.

Thus, in the common rail fuel injection system, in which a temporal deviation is caused until the control amount U is reflected in the actual pressure Pc, the unintended behavior of the actual pressure Pc due to the influence of the calculated differential term Ud can be averted when the target pressure Pctg increases during the reduction of the actual pressure Pc. Thus, aimed and suitable fuel injection is enabled. As a result, generation of particulate matters or nitrogen oxides in the exhaust gas is inhibited and generation of an abnormal noise is inhibited.

In the above-described embodiment, the drive control of the SCV 14 is performed to regulate the fuel pressure-feeding amount of the high-pressure pump 13. Alternatively, the fuel pressure-feeding amount may be regulated by controlling the pressure-feeding operation of the high-pressure pump 13 or by an electromagnetic discharge control valve provided on the pressure-feeding side.

In the above-described embodiment, the differential term Ud is set at zero at Step S213 of the first adjustment processing of FIG. 2B or Step S223 of the second adjustment processing of FIG. 2C. Alternatively, the unintended or excessive increase of the actual pressure Pc can be inhibited by setting the differential term Ud at a value closed to zero, i.e., a value in a permissible area that does not affect the drive control of the SCV 14.

In the above-described embodiment, the differential term Ud is adjusted by the first adjustment processing of FIG. 2B and the second adjustment processing of FIG. 2C when there is a possibility that the actual pressure Pc exhibits an unintended behavior. Alternatively, following processing may be performed. If the target pressure Pctg changes during the reduction of the actual pressure Pc, the ECU 20 calculates the change. The differential term Ud is set at zero or a value close to zero if the change of the target pressure Pctg is equal to or greater than a certain value and there is a possibility that the actual pressure Pc exhibits an unintended behavior. Thus, the adjustment of the differential term Ud is performed only when the target pressure Pctg rapidly increases during the reduction of the actual pressure Pc. Thus, a disadvantage of forfeiture of the braking effect due to the differential term calculation processing of FIGS. 2A to 2C is eliminated and the unintended behavior of the actual pressure Pc is averted.

In the above-described embodiment, the actual pressure Pc is reduced by the fuel injection or the fuel leak through the injectors 11 when the actual pressure Pc is higher than the target pressure Pctg. Alternatively, an electromagnetic pressure reduction valve may be provided in the common rail 12 and the actual pressure Pc may be reduced through drive control of the pressure reduction valve.

In the above-described embodiment, the present invention is applied to the four-cylinder diesel engine. The present invention may be applied to an engine having another number of cylinder(s) or a gasoline engine. In the case of the gasoline engine, the present invention can be applied to an in-cylinder injection gasoline engine that pressure-feeds gasoline with a fuel pump and accumulates the gasoline in a common rail (delivery pipe) to supply the gasoline into the engine through injection. In this case, a control delay due to the fuel pump or a transportation delay of the fuel through a fuel pressure-feeding pipe is caused. Therefore, the present invention can avert an unintended behavior of the actual pressure Pc due to the influence of the differential term.

The present invention should not be limited to the disclosed embodiments, but may be implemented in many other ways without departing from the spirit of the invention.

What is claimed is:

1. A controller of a common rail fuel injection system that accumulates high-pressure fuel pressure-fed by a fuel pump in a common rail and that performs injection supply of the accumulated fuel into an engine through a fuel injection valve, the controller performing fuel pressure feedback control for conforming fuel pressure in the common rail to target pressure by driving and controlling the fuel pump, the controller comprising:

a sensing device that senses the fuel pressure in the common rail;

a calculation device that calculates a differential term of a control amount of the fuel pump based on a pressure deviation of the fuel pressure sensed by the sensing device with respect to the target pressure;

a determination device that determines whether a determination condition is established, the determination condition established if the pressure deviation increases in accordance with an increase of the target pressure during reduction of the fuel pressure; and a restriction device that restricts reflection of the differential term in the control amount when the determination device determines that the determination condition is established.

2. The controller as in claim 1, wherein the determination device determines that the determination condition is established if the fuel pressure is higher than the target pressure and the differential term is a value increasing the fuel pressure.

3. The controller as in claim 1, wherein the determination device determines that the determination condition is established if the fuel pressure is lower than the target pressure as of present calculation of the control amount and the fuel pressure is higher than the target pressure as of previous calculation of the control amount.

4. The controller as in claim 1, wherein the restriction device temporarily sets the differential term calculated by the calculation device at zero or a value close to zero if the determination condition is established.

5. The controller as in claim 1, further comprising:

a change calculation device that calculates a change of the target pressure at every calculation of the control amount, wherein the restriction device restricts the reflection of the differential term in the control amount when the change calculated by the change calculation device is equal to or greater than a predetermined value and the determination condition is established.

6. The controller as in claim 1, wherein the fuel pump has a suction control valve that meters the fuel on a suction side of the fuel pump, and the fuel pressure feedback control is performed as drive control of the suction control valve.

7. The controller as in claim 1, wherein the differential term is set at zero when the pressure deviation is equal to or less than a certain value.

* * * * *